US008157055B2

(12) United States Patent
Stark et al.

(10) Patent No.: US 8,157,055 B2
(45) Date of Patent: Apr. 17, 2012

(54) LADDER CADDY AND STABILIZER

(76) Inventors: Glen A. Stark, Livonia, MI (US); Glenn S. Tokoph, Fowlerville, MI (US)

( * ) Notice: Subject to any disclaimer, the term of this patent is extended or adjusted under 35 U.S.C. 154(b) by 430 days.

(21) Appl. No.: 12/321,033

(22) Filed: Jan. 15, 2009

(65) Prior Publication Data

US 2009/0188752 A1 Jul. 30, 2009

Related U.S. Application Data

(60) Provisional application No. 61/062,034, filed on Jan. 23, 2008.

(51) Int. Cl.
*E06B 7/48* (2006.01)

(52) U.S. Cl. ..... 182/107; 182/129

(58) Field of Classification Search ..... 182/107, 182/108, 129
See application file for complete search history.

(56) References Cited

U.S. PATENT DOCUMENTS 3,072,218 A * 1/1963 Peters ..... 182/214
4,159,045 A * 6/1979 Brooks ..... 182/116
4,726,446 A * 2/1988 Perbix ..... 182/46
4,880,079 A * 11/1989 Leclerc ..... 182/107
4,974,699 A * 12/1990 Boring ..... 182/107
5,460,241 A * 10/1995 LaBelle ..... 182/214
6,565,051 B2 * 5/2003 Vaglica ..... 248/210
7,063,187 B1 * 6/2006 Lavigne ..... 182/129
7,575,097 B2 * 8/2009 Sheridan et al. ..... 182/206
7,753,170 B1 * 7/2010 Gibson ..... 182/107
2009/0188752 A1 * 7/2009 Stark et al. ..... 182/129

* cited by examiner

*Primary Examiner* — Blair M. Johnson
(74) *Attorney, Agent, or Firm* — The Weintraub Group, P.L.C.

(57) ABSTRACT

A ladder accessory or caddy that is connectible or removably mountable to the upper ends or rails of a ladder is adapted to position the ladder relative to a work structure and the ground and comprises an elongated rectangular shaped housing member and a resilient cushion member connected to the housing member. The housing has top and bottom walls, a pair of sidewalls, a forward and rearward end walls, and an interior wall. The walls cooperate to form a socket having an opening on the bottom, for receiving and closely fitting about the upper end portion of the ladder. The forward or cushioned end of the caddy is curvilinear and forms a "bull nose" for greater work surface contact area for stabilization. Also means for securing the caddy in position such as a biased latch may be provided to fix the caddy to the ladder while in use.

8 Claims, 2 Drawing Sheets

FIG 1
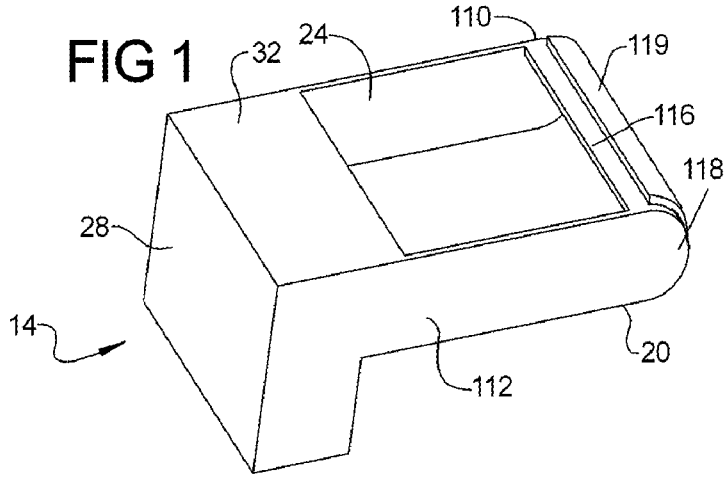
FIG 2
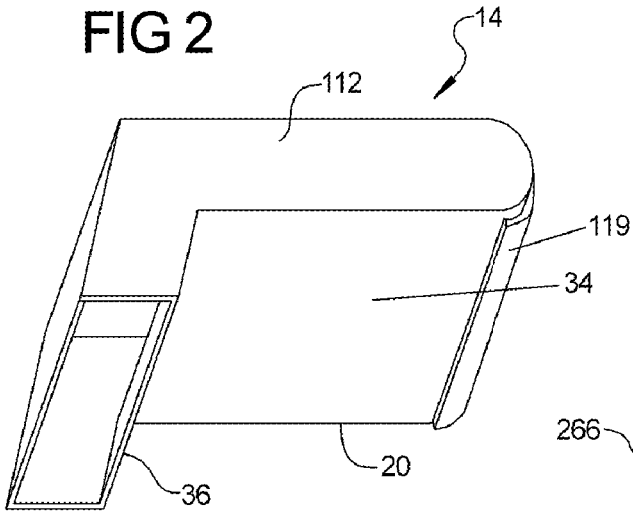
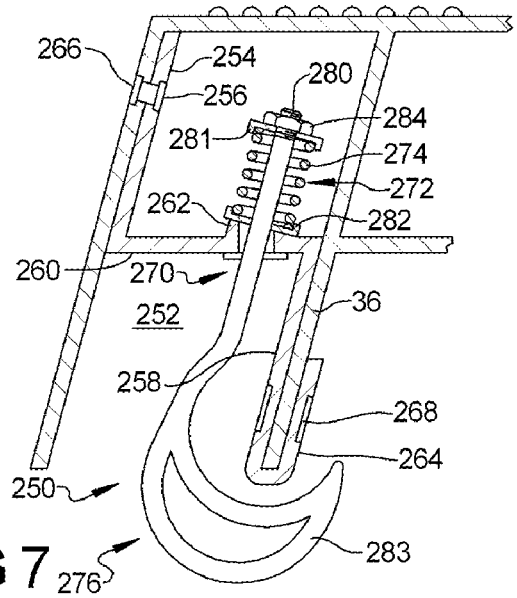
FIG 7

FIG 3
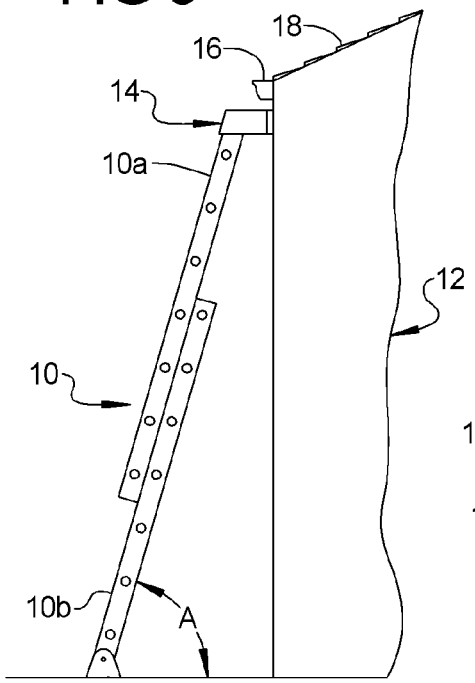
FIG 4
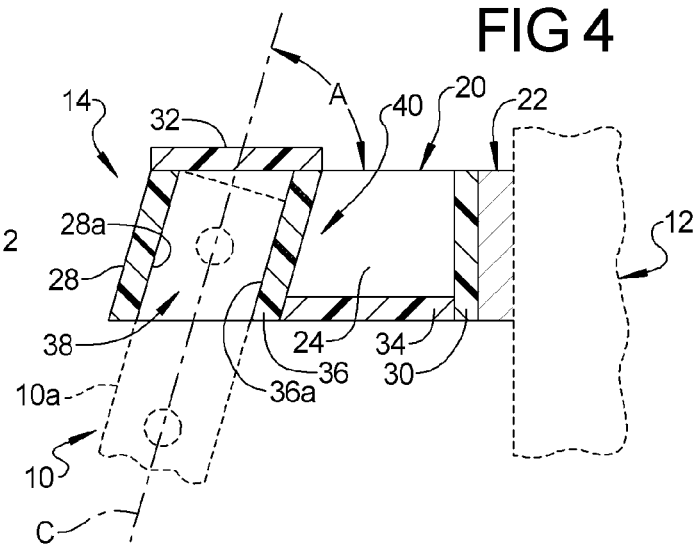
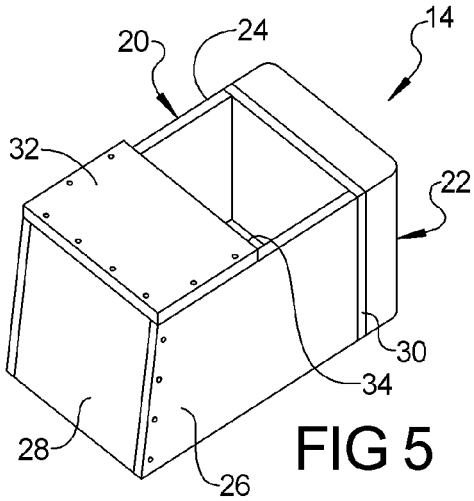
FIG 5
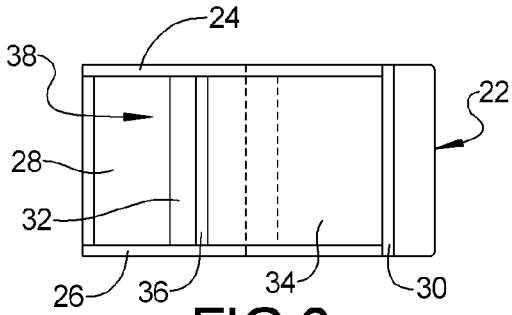
FIG 6

LADDER CADDY AND STABILIZER

CROSS-REFERENCE TO RELATED APPLICATIONS

This application is a completion application of co-pending U.S. Provisional Application No. 61/062,034, filed Jan. 23, 2008 for "LADDER CADDY AND STABILIZER," the entirety of which is hereby incorporated by reference.

BACKGROUND OF THE INVENTION

1. Field of the Invention

This invention relates to ladder accessories. More particularly this invention relates to a caddy that is connectible to the end of an extension ladder for holding and providing user ease of access to tools and like implements when working atop the ladder. Even more particularly, this invention relates to a tool caddy that, in use, stabilizes the ladder to increase the safety of the user, protects the structure being worked on from injury by engagement by the upper end of the ladder, and acts as an aid in positioning the ladder at an optimum angle relative to the ground and the structure.

2. Description of the Prior Art

Every year many persons are injured, while working on ladders, both at home and at construction sites. When working on a ladder it is often desirable for the user to have a convenient place to store various items, such as tools, small parts fasteners, liquid containers, brushes and the like in a readily accessible location. For example, workers have secured their tool pouches to the top rung of the ladder to facilitate access. However, this approach is awkward in that tools may drop or the pouch is inadequate to hold the tools necessary for the job to be performed.

Obviously, the top end portion of the ladder is a desirable location for positioning such tools. However there is danger in the worker having to reach down or away from the ladder because such movement could cause the ladder to sway.

Desirably, a ladder when positioned relative to a structure to be worked on should be stabilized.

Further, the top end of the ladder should not rest against weak upper surfaces. Additionally, if abutted against the structure being worked on, the ladder may mar or otherwise injure the exterior surface thereof. To obviate this latter situation, in some applications, a worker will place a rag, mitten or other cushioning member and the like about the upward extension of the ladder sides.

Provision of a ladder and/or accessory therefor that protects the structure from engagement with the ladder, stabilizes the ladder in relation thereto, and provides the user with ease of access to tools and the like to enable working on the roof, windows, gutters, etc. is desirable.

Importantly, the ladder should be at a proper angle to the structure being worked on. The proper angle for an extension ladder is achieved by setting the base out approximately one quarter of the ladder's height. For example, a sixteen-foot ladder should be set up with the base 4 feet out from the wall. Setting an extension ladder at too steep an angle makes for a difficult climb and increases the ladder's tendency to slide to the side or to tip over backward; setting it at too shallow of an angle increases the risk of the ladder dropping out from under the worker.

The American National Standards Institute recommends setting ladders at a 75.5° angle. Further, researchers at Liberty Mutual report that adjusting a ladder's angle a mere 10° degrees from 75° to 65° almost doubles the friction required to hold the ladder in place. If you increase the worker's climbing speed, the friction required jumps again by 7 percent.

However, in the real world, most workers have no way to measure ladder angle and have to frequently have to move the ladder into new work positions. A ladder accessory that enables the worker to have some indication of the ladder orientation including whether the rungs are level to the ground would be desirable.

Various accessories for use with a ladder have been suggested, such as in the following U.S. Pat. No. 4,306,632 to Brown, issued Dec. 22, 1981; U.S. Pat. No. 4,726,446 to Perbix, issued Feb. 23, 1988; U.S. Pat. No. 6,412,601 to Schmidt, issued Jul. 2, 2002; and U.S. Pat. No. 6,945,359 to Logiudice, issued Sep. 20, 1995; as well as U.S Patent Publication Nos. 2002/0134619 Schwenke, published Sep. 26, 2002; 2005/0045421 to Gaines, published Mar. 3, 2005; and 2006/0266583 to Jones, published Nov. 30, 2006, the disclosures of which are hereby incorporated by reference. However, none of theprior art addresses ease of access to tools while preventing injury to the working surface as well as providing ladder stabilization.

Thus, there is an ongoing need for improvements relating to the safe and effective use of a ladder.

The primary objective of this invention is the provision of a ladder accessory that enables the worker to place work tools atop a ladder and in position for use, protects the structure being worked on while assuring tool access, stabilizes the ladder by inhibiting lateral sway, and enables rapid estimation of the fact that the ladder is approximately at the optimum angle relative to the structure for safe use.

SUMMARY OF THE INVENTION

According to the first embodiment of the present invention, there is provided a ladder accessory that is connectible or removably mountable to the upper end of a ladder having two axially elongated legs of given dimension and having lower ends supportable on the ground. The ladder accessory hereof is adapted to position the ladder relative to a work structure and the ground and comprises: (a) an elongated rectangular shaped housing member and (b) a resilient cushion member connected to the housing member. The housing member has a top and a bottom wall, a pair of sidewalls, a forward and a rearward end wall, and an interior wall. The walls cooperate, at least in part, to form a socket, having an opening on the bottom, for receiving and closely fitting about the upper end portion of the ladder and in a manner that the housing member is oriented at a predetermined angle relative to the legs of the ladder. The cushion member is connected to the forward end wall of the housing member and engages the work structure to inhibit the upper end of the ladder from swaying relative to the work structure while protecting the surface of the work structure from marring or being dented, scratched or the like.

According to a preferred embodiment, the ladder accessory is in the form of a tool caddy, wherein the housing member comprises an upwardly open chamber that is formed in part by said bottom wall, said forward end wall and said sidewalls. The chamber provides a tool storage and work area.

According to this invention, the socket includes and is formed by a second wall, the second wall and rearward end wall being in parallel relation to one another and at an acute angle relative to the top wall.

Preferably, the acute angle is about 75.5°.

In use, when the housing or housing member is affixed to the upper end portion of the ladder, it is at a predetermined angle relative to the legs of the ladder. The lower end portion of the ladder is supported on the ground and the upper end and the cushion of the housing member is positioned against the work structure. When the top of the housing member is essentially horizontally disposed relative to the ground, the legs and the ladder are disposed at approximately 75.5° to the ground.

According to a second preferred embodiment, there is disclosed an accessory for a ladder of the type including a pair of longitudinally extending legs having respective outer sides and upper and lower edges and mountable against a work structure. The accessory comprises a tool caddy configured to fit about the upper end of the ladder and carry work implements and provided with a resilient cushion to stabilize and support the ladder against the work structure. The caddy includes a pair of laterally spaced sidewalls and first and second angled walls extending between the sidewalls. The walls are configured to form a socket to receive the upper end of the ladder with the sidewalls juxtaposed with a respective lateral side of the ladder rails. The first and second angled walls, respectively, engage, at least in part, a respective upper and lower longitudinal edges of the ladder rails. The cushion is disposed in spaced relation to said angled walls.

According to a third embodiment hereof, there is disclosed a ladder accessory for holding tools. The accessory comprises a housing member having a top and a bottom, first and second ends, and a resilient cushion disposed on said second end for engaging a work surface and stabilizing the assembly of the housing member and ladder relative to the work surface. The housing member is configured to include: (a) a downwardly open socket proximate to said first end for receiving and connecting the housing member to the upper end of the ladder, and (b) an upwardly open chamber proximate to said second end for receiving and positioning tools within easy reach of a workman when working on the ladder. The socket is at an acute angle to a line drawn between the first and second ends so as to position the housing member at an acute angle to the ladder when connected thereto.

According to a further embodiment hereof, the forward or cushioned end of the caddy is curvilinear and forms a "bull nose" for greater work surface contact area for stabilization. Also means for securing the caddy in position such as a biased latch may be provided to fix the caddy to the ladder while in use.

For a more complete understanding of the present invention, reference is made to the following detailed description and accompanying drawings. In the drawings, like reference characters refer to like parts throughout the several views, in which:

BRIEF DESCRIPTION OF THE DRAWINGS

FIG. 1 is a perspective view of a first embodiment of a ladder accessory in accordance herewith as viewed from the top;

FIG. 2 is a perspective view of the first embodiment hereof as seen from the bottom;

FIG. 3 is a side view of a ladder accessory of the present invention attached to and stabilizing the upper end of a ladder against a structure;

FIG. 4 is an enlarged section view of the arrangement of FIG. 3 showing the ladder accessory connected to the upper end portion of the ladder and in relation to the work structure, the ladder and structure being shown in phantom;

FIG. 5 is second perspective view looking down at the top of the ladder accessory;

FIG. 6 is a plan view looking up at the bottom of the ladder accessory, and

FIG. 7 is a partial cross-sectional view of a further embodiment of the present invention.

DETAILED DESCRIPTION OF A PREFERRED EMBODIMENT OF THE INVENTION

Referring now to the drawings and to FIGS. 1-5, a ladder 10 having an upper end portion 10*a* and a lower end portion 10*b* is shown in use with a building structure 12 with the lower end portion 10*b* of the ladder being supported on the ground. A ladder accessory 14, according to this invention, is shown as mounted to the upper end portion 10*b* of the ladder 10. The accessory or caddy 14 stabilizes and positions the ladder 10 relative to the structure 12. As shown, the structure 12 is a house having a gutter 16 and roof 18. Although the ladder accessory 14 can be positioned against objects in any suitable manner, as shown in FIG.3 the ladder accessory 14 is positioned below the the gutter 16. The ladder accessory 14 may also be described as a ladder caddy or tool caddy in that the accessory is configured to store various items, such as tools, small parts fasteners, liquid containers, brushes and the like in a manner to be readily accessible when working on the structure atop the ladder.

The ladder 10 is conventional and can comprise a single one-piece section or, as shown, can comprise a pair of sections that extend relative to one another. The ladder section comprises a pair of longitudinally elongated laterally spaced legs or rails, and a plurality of rungs, the rungs extending between the rails and in parallel fashion between the opposite ends of the legs.

Typically, the end portions 10*a* and 10*b* of the ladder 10 are of predetermined dimension and shape, and the legs thereof include planar sides and upper and lower edges. FIG. 2 illustrates the nested captivated relation of the upper end portion of the ladder relative to the ladder accessory 14.

Referring to FIGS. 2-5, the ladder accessory 14 comprises a generally box-shaped housing member 20 and a support cushion 22. The housing member or housing 20 comprises: (a) a pair of laterally spaced trapezoidally shaped planar sidewalls 24 and 26, (b) a pair of longitudinally spaced rectangularly shaped planar rearward and forward end walls 28 and 30, (c) a planar rectangularly shaped top wall 32, (d) a planar rectangularly shaped bottom wall 34, and (e) a planar rectangularly shaped interior wall 36. The sidewalls 24 and 26, and the top and bottom walls 32 and 34, respectively, are generally parallel to one another. Further the rearward end wall 28 and interior wall 36 are generally in parallel spaced relation to one another and at an acute angle to the top and bottom walls 32 and 34.

Importantly, the sidewalls 24 and 26, rearward wall 28 and interior wall 36, and top wall 32 cooperate to form, in part, an angled rectangularly shaped throat and socket 38 sized to receive and snugly fit about and captivate the upper end portion 10*b* of the ladder 10. The socket 38 opens on the bottom of the housing member to receive and connect to the upper end portion of the ladder thereto.

As shown in FIG.4, when connected to the ladder, the tool caddy or ladder accessory 14 is generally at an angle "A" relative to a longitudinal axis "C" through the ladder 10.

When the ladder and accessory are assembled together and the accessory is supported against the structure 12, the interior surfaces 28*a* and 36*a* of the angled walls 26 and 36 that form the socket 38, at least in part, engage the upper and lower edges of the ladder legs wherein to resist movement or relative disconnecting relative movement therebetween.

The housing member or housing 20 is also configured to carry work implements. In this regard, the sidewalls 24 and 26, the forward end wall 30, the interior wall 36, and the bottom wall 30 of the housing cooperate to form, at least in part, an upwardly open chamber 40 for storing items that are to be used when working on the structure 12.

The resilient cushion 22 is comprised of a material that will yield but resist sliding movement. Suitable materials are known to those skilled in the art and may include an elastomer, a rubber, and other resiliently compressible polymers.

While shown as being generally coextensive with the forward end wall 30, the material of the cushion 22 may extend into at least partial covering relation with the sidewalls 24 and 26.

Importantly, the resilient cushion 22 inhibits the ladder from damaging the structure and also provides a stabilizing effect. The cushion inhibits the upper end portion of the ladder from lateral sway relative to the ground arising from movement by the worker atop the ladder.

The top wall 32 is preferably oriented relative to the housing member 20 such that the top wall is at a predetermined angle relative to the rearward end wall 28 and interior wall 36 (i.e., the socket 38). That is, when the housing member 20 is connected to the upper end of the ladder and the cushion 22 is disposed against the structure 12, if the top wall 32 is generally horizontally disposed relative to the ground, the ladder is at an optimum angle "A" relative to the ground.

Preferably, the angle "A" is about 70°-80°, and optimally, at about 75.5°. As noted, this angle is believed to enable the ladder to remain stable in an extended position with the worker thereatop. The further addition of the stabilizing cushion 22 further contributes to the stability of the extended ladder 10 with worker thereatop.

It should be noted that the top wall 32 defines a work area or surface 40. It may be knurled or otherwise roughened to enhance frictional holding of a tool emplaced thereon.

As shown in FIGS. 1 and 2, the forward wall 110 may optionally be curvilinear and be integrally formed with the side walls 112, 114 to form a front surface 116. The side walls 112, 114 are complementarily curvilinear and co-extensive with the forward wall 110 at their front edge. The forward edges and front wall cooperate to form a "bullnose" front section, generally, denoted at 118. A cushioning member 119 is secured to the bullnose front wall.

The curvilinear or bull nose front section 118 provides further stability when the ladder caddy 14 engages a roof because of the increase in contact surface between the section 118 and the structure 12.

As shown in FIG. 7, the accessory may also comprise means 250 for securing the accessory to the ladder 10 disposed within the socket 252.

The means 250 can comprise a socket insert 254 having a pair of axially spaced apart parallel walls 256, 258 and an intermediate connecting ledge 260. As shown, the ledge 260 traverses the interior of the socket and extends between the walls 256, 258. The ledge 260 includes an opening or aperture 262 which extends therethrough. The wall 258, also, includes a J-shaped portion 264 which envelops and encircles the lower end of the wall 36, as shown.

The insert is fixed in position by any suitable means such as fastening members 266, 268 or the like.

Similarly, the accessory hereof may be formed from a plastic material or the like and, thus, may be molded or otherwise formed. Under such situations, the insert 254 would be integrally formed with the accessory.

Referring again to the drawings, the means 250, preferably, comprises a grasping member 270 and means 272 for biasing the member 270 in a manner to resist the upper ends of the ladder from coming out of the socket 252.

More particularly, and as shown, means for biasing such as a coil spring 274 surmounts the grasping member 270 along a portion thereof. The grasping member 270, itself, comprises a member, such as a hook 276 which extends through the ledge 260 via an opening 278, as shown. The hook 276 is essentially a J-shaped member comprising a threaded shank 280 and a J-shaped lower end 283 for engaging a ladder rung. The hook 283 is adapted to engage a rung or side rail of the ladder to secure the accessory to the ladder by grasping it and pulling it around a rung or a side rail against the force of the spring.

As shown, a pair of spacers 281, 282 disposed atop the ledge 260 trap the spring 274 therebetween. A fastener, such as nut 284 is threadably secured to the shank 280, as shown, above the spacer 281 and is threadably moveable theregainst to adjust the compression of the spring in the well-known manner.

Also, although not shown in the drawing, a track may be fixedly secured to the front wall with a pair of opposed, slideable arms slidably disposed within the track. Each arm, as contemplated, comprises a substantially L-shaped member having a first leg slideably mounted within the track and an upstanding second leg which is integral with a substantially normal to the first leg. Preferably, each of the upstanding second legs is shrouded with a padding to facilitate grasping or the like. Each of the arms is extensible and retractable within the track. Suitable stops are disposed at each end of the track to limit the extension to prevent the arms from being fully extended and out of the track. These extensible arms add further stability to the device.

It should be noted that the present invention enables a ladder to be safely positioned below gutters, on a roof, adjacent or below windows, etc. The device provides a tool storage, work surface useful for siding installation, gutter cleaning, gutter and window insulation, painting and the like. In this regard the top surface or wall of the caddy may be knurled or otherwise roughened (FIG. 7) to provide a friction surface for improving the working surface.

From the above it is apparent that there has been described herein a device for facilitating access to tools, and the like when working atop a ladder.

Having, thus, discussed the invention, what is claimed is:

1. A ladder caddy for securely positioning a ladder in place against a work surface, the ladder caddy being attachable to the upper ends of the ladder's stringers, the ladder caddy comprising:

an elongated housing having a bottom wall, a pair of laterally spaced apart sidewalls, a rear wall, and a curvilinear bullnose-shaped front wall cooperating to form an interior chamber, the front wall having a resilient cushion member for engaging the work surface;

a socket formed in the housing for receiving the upper ends of the stringers and removably retaining the upper ends of the stringers therein, the socket including a ledge having an opening;

and a hook and means for biasing the hook toward the housing, the hook and means for biasing being disposed within the socket, the hook extending through the opening and having a threaded shank position above the ledge and a J-shaped member disposed below the ledge for attachment to a rung on the ladder;

wherein the hook entraps the ladder rung and the means for biasing draws the hook toward the housing to secure the housing into engagement with the ladder.

2. The ladder caddy of claim 1 wherein the housing comprises:

a top wall and an interior wall, the top wall being substantially parallel with the bottom wall and extending at least partially forwardly from a top of the rear wall, and the interior wall being substantially parallel with the rear wall and extending between the bottom wall and the top wall.

3. The ladder caddy of claim 2, wherein:

the sidewalls are substantially parallel to one another and the rear wall and the interior wall are oriented at an acute angle A to the top and bottom walls.

4. The ladder caddy of claim 3, wherein:

the sidewalls, the rear wall, the interior wall, and the top wall cooperate to form, in part, the socket, the socket being sized to receive and snugly fit about and captivate the upper ends of the ladder's stringers.

5. The ladder caddy of claim 1 wherein:

the bullnose front wall extends upwardly along a curved plane from the bottom wall.

6. The ladder caddy of claim l wherein:

the means for biasing comprises a threaded nut which is threadably interengaged with the threaded shank, whereby tightening the nut on the shank draws the J-shaped member toward the housing and into secure engagement with the ladder rung.

7. The ladder caddy of claim 3 wherein the acute angle A is 70°-80°.

8. The ladder caddy of claim 7 wherein the acute angle A is about 75.5°.

* * * * *